US009858869B2

(12) United States Patent
Yoo et al.

(10) Patent No.: US 9,858,869 B2
(45) Date of Patent: Jan. 2, 2018

(54) DISPLAY APPARATUS AND METHOD OF DRIVING THE SAME

(71) Applicant: SAMSUNG DISPLAY CO., LTD., Yongin-si, Gyeonggi-do (KR)

(72) Inventors: Donggon Yoo, Incheon (KR); Kwanyoung Han, Seongnam-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 34 days.

(21) Appl. No.: 14/973,609

(22) Filed: Dec. 17, 2015

(65) Prior Publication Data

US 2016/0293113 A1 Oct. 6, 2016

(30) Foreign Application Priority Data

Mar. 31, 2015 (KR) ..... 10-2015-0045466

(51) Int. Cl.
*G09G 3/36* (2006.01)
*G09G 3/34* (2006.01)

(52) U.S. Cl.
CPC ..... *G09G 3/3406* (2013.01); *G09G 3/3666* (2013.01); *G09G 2320/0261* (2013.01); *G09G 2320/064* (2013.01); *G09G 2320/0686* (2013.01); *G09G 2330/021* (2013.01); *G09G 2340/0407* (2013.01); *G09G 2354/00* (2013.01)

(58) Field of Classification Search
CPC ..... G09G 2320/271–2320/276
See application file for complete search history.

(56) References Cited

U.S. PATENT DOCUMENTS

2012/0218255 A1 8/2012 Tsuchida
2014/0285431 A1* 9/2014 Yeom ..... G09G 5/00 345/156
2016/0351133 A1* 12/2016 Kim ..... G09G 3/3406

FOREIGN PATENT DOCUMENTS

KR 10-2005-0023232 A 3/2005
KR 10-2009-0055873 A 6/2009
KR 10-2012-0045509 A 5/2012
(Continued)

OTHER PUBLICATIONS

Chang, N. et al., DLS: Dynamic Backlight Luminance Scaling of Liquid Crystal Display, IEEE Transactions on Very Large Scale Integration (VLSI) Systems, Aug. 2004, pp. 837-846, vol. 12, No. 8, IEEE.

(Continued)

*Primary Examiner* — Sanghyuk Park
(74) *Attorney, Agent, or Firm* — Lewis Roca Rothgerber Christie LLP

(57) ABSTRACT

A method for operating a display apparatus includes: determining a maximum clipping area based on a viewing distance of a viewer; generating a first clipping point based on at least the maximum clipping area; determining a final clipping point based on at least the first clipping point; generating output image data based on the final clipping point and input image data; displaying an image corresponding to the output image data; generating a backlight control signal based on the final clipping point; and emitting backlight based on the backlight control signal, wherein the maximum clipping area includes a maximum area of a deterioration area that cannot be perceivable by a viewer according to the viewing distance.

20 Claims, 13 Drawing Sheets

(56) References Cited

FOREIGN PATENT DOCUMENTS

| | | | |
|---|---|---|---|
| KR | 10-2013-0065091 | A | 6/2013 |
| KR | 10-1460041 | B1 | 11/2014 |

OTHER PUBLICATIONS

Hsia, S. et al., High-Performance Local Dimming Algorithm and Its Hardware Implementation for LCD Backlight, Journal of Display Technology, Jul. 2013, pp. 527-535, vol. 9, No. 7, IEEE.

Yoo, D. et al., Viewing Distance-Aware Backlight Dimming of Liquid Crystal Displays, Journal of Display Technology, Oct. 2014, pp. 867-874, vol. 10, No. 10, IEEE.

Yoo, D. et al., Viewing Distance-Based Perceived Error Control for Local Backlight Dimming, Journal of Display Technology, Mar. 2015, pp. 304-310, vol. 11, No. 3, IEEE.

* cited by examiner

DISPLAY APPARATUS AND METHOD OF DRIVING THE SAME

CROSS-REFERENCE TO RELATED APPLICATION

This patent application claims priority to and the benefit of Korean Patent Application No. 10-2015-0045466, filed on Mar. 31, 2015, the entire content of which is hereby incorporated by reference.

BACKGROUND

One or more embodiments of the present disclosure relate to a display apparatus and a method of driving the same.

In general, a liquid crystal display (LCD) apparatus includes an LCD panel for displaying an image by using the light transmittance of liquid crystals and a backlight unit for providing backlight to the LCD panel.

A recent LCD apparatus applies dimming that decreases the luminance of backlight and increases the light transmittance of a pixel on the LCD panel, according to an image. The dimming divides the backlight unit into a plurality of blocks and enables the light sources of the blocks to emit light at different luminance levels.

However, an amount of data to be processed for processing the algorithm of the dimming may increase, and image quality may deteriorate due to the dimming.

The above information disclosed in this Background section is only for enhancement of understanding of the background of the inventive concept and therefore it may contain information that does not form prior art.

SUMMARY

One or more embodiments of the present disclosure provide a display apparatus having a backlight unit capable of decreasing power consumption, and a method of driving the same.

One or more embodiments of the present disclosure provide a display apparatus having a backlight unit capable of improving image quality and a method of driving the same.

According to some embodiments of the present disclosure, a method for operating a display includes: determining a maximum clipping area based on a viewing distance of a viewer; generating a first clipping point based on at least the maximum clipping area; determining a final clipping point based on at least the first clipping point; generating output image data based on the final clipping point and input image data; displaying an image corresponding to the output image data; generating a backlight control signal based on the final clipping point; and emitting backlight based on the backlight control signal, wherein the maximum clipping area includes a maximum area of a deterioration area that cannot be perceived by a viewer according to the viewing distance.

In some embodiments, the method may further include: receiving a minimum peak signal noise ratio (PSNR); and generating a second clipping point based on at least the minimum PSNR, wherein the determining of the final clipping point comprises generating the final clipping point based on the first and second clipping points.

In some embodiments, the determining of the final clipping point may include: selecting the second clipping point when the first clipping point is smaller than the second clipping point; and selecting the first clipping point when the first clipping point is greater than the second clipping point.

In some embodiments, the generating of the first clipping point may include: determining a maximum number of clipping pixels based on the maximum clipping area and on a number of pixels per unit area of a display panel; and generating the first clipping point based on the maximum number of clipping pixels.

In some embodiments, the maximum number of clipping pixels may be determined by Nmax=CAmax×PDA, where Nmax refers to the maximum number of clipping pixels, CAmax refers to the maximum clipping area and PDA refers to the number of pixels per unit area of the display panel.

In some embodiments, the generating of the first clipping point may include: generating a histogram according to gray scale levels of the input image data; and generating the first clipping point based on the histogram and the maximum number of clipping pixels.

In some embodiments, the first clipping point may be determined by $$Ncp(g) = \sum_{k=g}^{255} Hist(k)$$

$$Ncp(g) < N\max,$$

where Ncp(g) refers to a number of plurality of pixel data of the input image data that is clipped when the first clipping point CP1 is g, Hist(k) refers to the number of plurality of pixel data corresponding to a gray scale value of k, and Nmax refers to the maximum number of clipping pixels.

In some embodiments, the generating of the second clipping point may include: generating a maximum clipping level based on the minimum PSNR; and extracting a maximum gray scale value of the input image data, wherein the second clipping point may include a value obtained by subtracting the maximum clipping level from the maximum gray scale value of the input image data.

In some embodiments, the maximum clipping level CLmax may be determined by $$CL\max = \frac{255}{10^{\frac{PSNRmin}{20}}},$$

where PSNRmin refers to the minimum PSNR.

In some embodiments, the input image data may include a plurality of sub input image data corresponding respectively to a plurality of dimming areas of the display panel, the first clipping point may include a plurality of first sub clipping points corresponding respectively to the dimming areas, and the generating of the first clipping point may include generating a plurality of sub histograms based respectively on the gray scale values of the plurality of sub input image data, and generating the plurality of first sub clipping points based respectively on the plurality of sub histograms and the maximum number of clipping pixels.

In some embodiments, the second clipping point may include a plurality of second sub clipping points corresponding to the dimming areas, and the generating of the second clipping point may include respectively generating block reference values of the dimming areas based on the plurality of sub input image data, and generating the second sub clipping points by subtracting the maximum clipping level from the block reference values.

In some embodiments, the block reference values may include maximum gray scale values of the plurality of sub input image data, respectively.

In some embodiments, the generating of the second clipping point may include: calculating average gray scale values of sub dimming areas of each of the dimming areas; and generating a maximum value of the average gray scale values of each of the dimming areas as the block reference values.

In some embodiments, the determining of the final clipping point may include generating a plurality of sub final clipping points of the final clipping point based respectively on the first and second sub clipping points, the generating of the output image data may include generating a plurality of sub output image data based respectively on the sub final clipping points, the generating of the backlight control signal may include generating a plurality of sub backlight control signals of the backlight control signal based respectively on the sub final clipping points, and the dimming areas may respectively display images corresponding to the plurality of sub image data, and a plurality of light source blocks corresponding respectively to the dimming areas may emit backlight corresponding respectively to the sub backlight controls signals.

In some embodiments, the maximum clipping area CAmax may be determined by $CAmax=CAnorm\times D^2$, where D refers to the viewing distance, and CAnorm refers to a normalized maximum clipping area for a viewing distance equal to about 1 m.

In some embodiments, the method may further include sensing the viewing distance.

According to some embodiments of the present disclosure, a display apparatus includes: a backlight source configured to emit backlight based on a backlight control signal; a display panel configured to receive the backlight and to display an image corresponding to output image data; and a controller comprising: a clipping point processor configured to determine a maximum clipping area based on a viewing distance of a viewer, to generate a first clipping point based on at least the maximum clipping area, and to determine a final clipping point based on at least the first clipping point; an image processor configured to generate the output image data based on the final clipping point and input image data; and a backlight controller configured to generate the backlight control signal based on the final clipping point, wherein the maximum clipping area includes a maximum area of a deterioration area that cannot be perceived by the viewer according to the viewing distance.

In some embodiments, the clipping point processor may include: a first clipping point generator configured to generate the first clipping point based on at least the maximum clipping area; a second clipping point generator configured to generate a second clipping point based on at least a minimum PSNR; and a final clipping point determiner configured to generate the final clipping point based on the first and second clipping points.

In some embodiments, the first clipping point generator may be configured to determine a maximum number of clipping pixels based on the maximum clipping area and a number of pixels per unit area of the display panel, and to generate the first clipping point based on the maximum number of clipping pixels.

In some embodiments, the first clipping point generator may be configured to generate a histogram based on gray scale values of the input image data, and to generate the first clipping point based on the histogram and the maximum number of clipping pixels.

BRIEF DESCRIPTION OF THE FIGURES

The above and other aspects and features of the inventive concept will become apparent to those skilled in the art from the following detailed description of the example embodiments with reference to the accompanying drawings. In the drawings.

DETAILED DESCRIPTION

Figure 1:
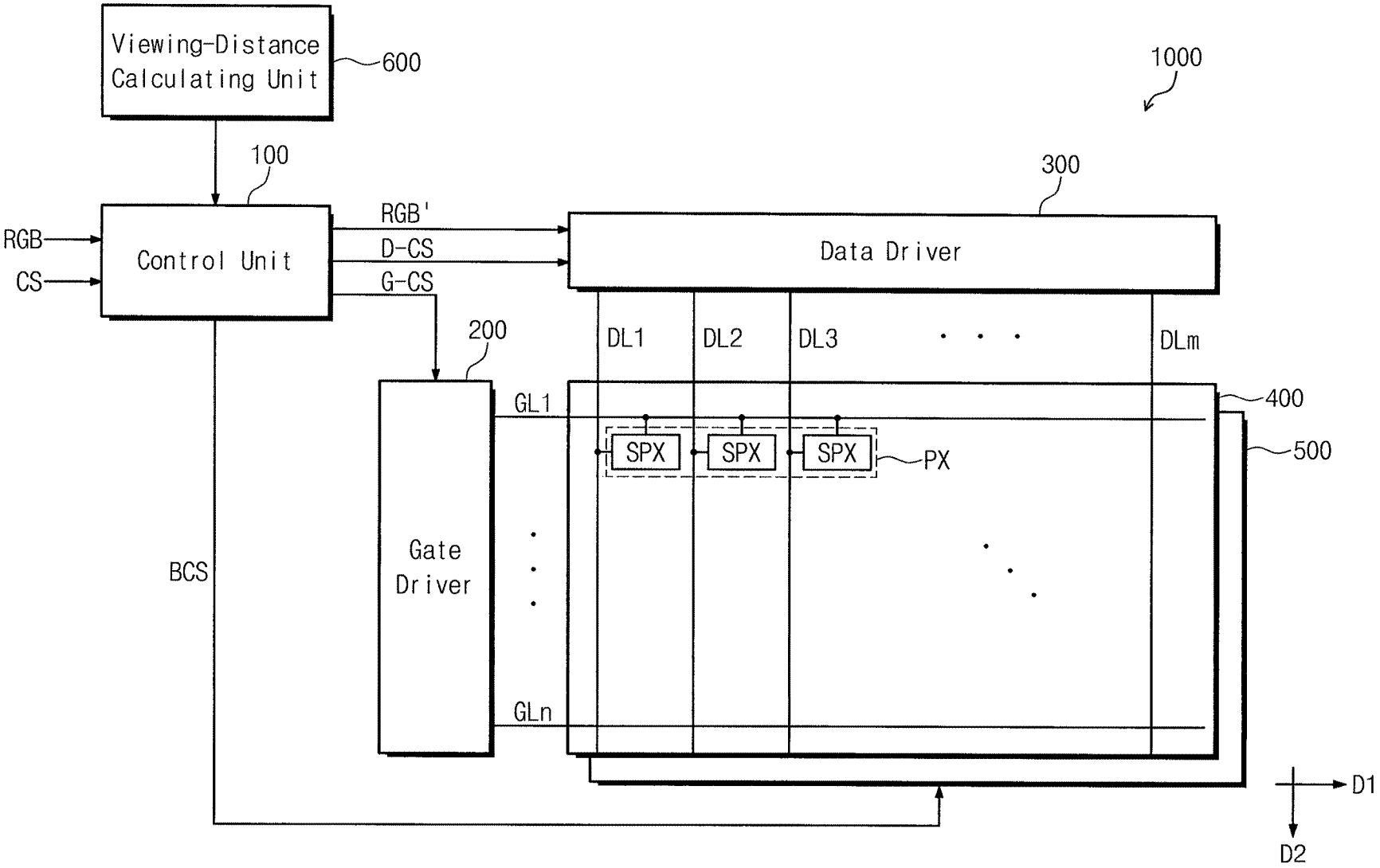
FIG. 1 is a block diagram of a display apparatus according to an embodiment of the inventive concept.

Hereinafter, example embodiments will be described in more detail with reference to the accompanying drawings. The inventive concept, however, may be embodied in various different forms, and should not be construed as being limited to only the illustrated embodiments herein. Rather, these embodiments are provided as examples so that this disclosure will be thorough and complete, and will fully convey the aspects and features of the inventive concept to those skilled in the art. Accordingly, processes, elements, and techniques that are not necessary to those having ordinary skill in the art for a complete understanding of the aspects and features of the inventive concept may not be described. Unless otherwise noted, like reference numerals denote like elements throughout the attached drawings and the written description.

In the drawings, the relative sizes of elements, layers, and regions may be exaggerated for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Unless otherwise noted, like reference numerals denote like elements throughout the attached drawings and the written description, and thus, descriptions thereof may not be repeated.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the inventive concept. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the inventive concept refers to "one or more embodiments of the inventive concept." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the inventive concept described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the inventive concept.

Unless otherwise defined, all terms (including technical and scientific terms) used herein have the same meaning as commonly understood by one of ordinary skill in the art to which the inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Exemplary embodiments of the inventive concept are described below in more detail with reference to the accompanying drawings.

FIG. 1 is a block diagram of a display apparatus according to an embodiment of the inventive concept.

Referring to FIG. 1, a display apparatus 1000 according to an embodiment of the inventive concept includes a display panel 400 for displaying an image, a panel driver for driving the display panel 400, and a backlight unit (e.g., a backlight source or backlight) 500 for supplying backlight to the display panel 400. The panel driver may include a gate driver 200, a data driver 300, and a control unit (e.g., controller or timing controller) 100 for controlling the driving of the gate driver 200 and the data driver 300.

The control unit 100 receives a plurality of control signals CS and input image data RGB including information on an image to be displayed, from the outside of the display apparatus 1000. The control unit 100 converts the input image data RGB into output image data RGB' to be suitable for the interface specifications of the data driver 300 and the display panel 400. Also, the control unit 100 generates a data control signal D-CS (e.g., including output start signal and horizontal start signal) and a gate control signal G-CS (e.g., including vertical start signal, vertical clock signal and vertical clock-bar signal) based on the plurality of control signals CS. The data control signal D-CS is provided to the data driver 300, and the gate control signal G-CS is provided to the gate driver 200. Also, the control unit 100 generates a backlight control signal BCS, and provides the backlight control signal BCS to the backlight unit 500.

The gate driver 200 sequentially outputs gate signals in response to the gate control signal G-CS provided from the control unit 100.

In response to the data control signal D-CS provided from the control unit 100, the data driver 300 converts the output image data RGB' into data voltages to output the data voltages. The output data voltages are applied to the display panel 400.

The display panel 400 includes a plurality of gate lines GL1 to GLn, a plurality of data lines DL1 to DLm, and a plurality of pixels PX. The plurality of gate lines GL1 to GLn extend in a first direction D1 and are arranged in parallel to one another along a second direction D2. The plurality of data lines DL1 to DLm are insulated from the plurality of gate lines GL1 to GLn and cross the plurality of gate lines GL1 to GLn. For example, the plurality of data lines DL1 to DLm extend in the second direction D2 and are arranged in parallel to one another along the first direction D1. For example, the first and second directions D1 and D2 may be parallel to row and column directions that are orthogonal to each other, respectively. As an example of the inventive concept, the display panel 400 may be an LCD panel.

Each of the plurality of the pixels PX is a device for displaying a unit image, and the resolution of the display panel 400 may be determined according to the number of the pixels PX in the display panel 400. In FIG. 1, for ease of illustration, only one pixel PX is shown and the other pixels are omitted.

Each of the plurality of pixels PX includes a plurality of sub pixels SPX. Each of the sub pixels SPX includes a thin film transistor TR and a liquid crystal capacitor Clc (see FIG. 2). The pixels PX may be scanned on a row by row basis (e.g., sequentially) by the gate signals. Each of the plurality of pixels PX may include, for example, three sub pixels SPX, but the inventive concept is not limited thereto. The sub pixels SPX may display any one of primary colors, such as red, green, and blue colors. Although FIG. 1 shows a structure in which each of the plurality of pixels PX includes three sub pixels SPX, each of the pixels PX may include two sub pixels or four or more sub pixels. Also, colors expressed by the sub pixels SPX are not limited to the red, green, and blue colors, and the sub pixels SPX may express other colors in addition to or in lieu of the red, green, and blue colors.

As shown in FIG. 1, the backlight unit 500 is located on the rear side of the display panel 400 and supplies light to the rear surface of the display panel 400. The luminance of backlight emitted from the backlight unit 500 may be controlled by the backlight control signal BCS.

Also, the display apparatus 1000 includes a viewing-distance calculating unit (e.g., a viewing-distance calculator) 600. The viewing-distance calculating unit 600 may sense the location of a viewer viewing the display apparatus 1000, and may calculate the viewing distance of the viewer according to the distance between the location of the viewer and the display panel 400. In one example embodiment of the inventive concept, the viewing-distance calculating unit 600 may include, for example, a stereo camera and/or a camera capable of obtaining depth information, such as a depth camera, and may calculate the viewing distance through the depth information. In one embodiment, the viewing-distance calculating unit 600 may include a mono camera for detecting a viewer's face size corresponding to the viewing distance, and may calculate the viewing distance based on the detected viewer's face size. However, the inventive concept is not limited to the above-described embodiments, and the viewing-distance calculating unit 600 may include any suitable sensor capable of detecting information corresponding to a viewing distance of the viewer.

Figure 2:
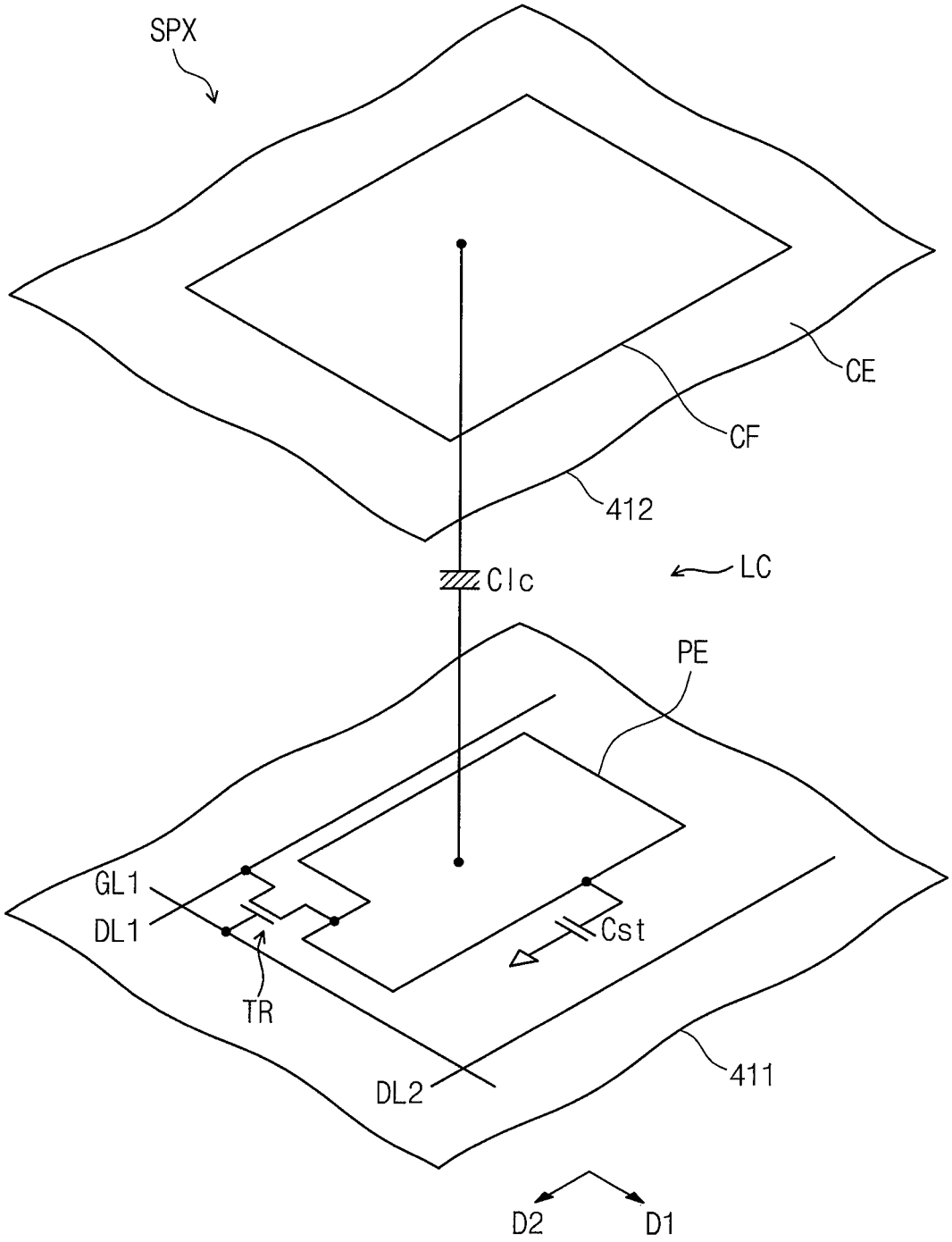
FIG. 2 is a schematic perspective view of a sub pixel in FIG. 1.

FIG. 2 is a schematic perspective view of a sub pixel in FIG. 1.

Referring to FIG. 2, the display panel 400 (see FIG. 1) includes a first substrate 411, a second substrate 412 facing the first substrate 411, and a liquid crystal layer LC between the first substrate 411 and the second substrate 412.

The sub pixel SPX includes a thin film transistor TR connected to the first gate line GL1 and to the first data line DL1, a liquid crystal capacitor Clc connected to the thin film transistor TR, and a storage capacitor Cst connected in parallel to the liquid crystal capacitor Clc. In one embodiment, the storage capacitor Cst may be omitted.

The thin film transistor TR may be disposed on the first substrate 411. The thin film transistor TR includes a gate electrode connected to the first gate line GL1, a source electrode connected to the first data line DL1, and a drain electrode connected to the liquid crystal capacitor Clc and to the storage capacitor Cst.

The liquid crystal capacitor Clc includes a pixel electrode PE disposed on the first substrate 411, a common electrode CE disposed on the second substrate 412, and the liquid crystal layer LC disposed between the pixel electrode PE and the common electrode CE. In this case, the liquid crystal layer LC functions as a dielectric. The pixel electrode PE is connected to the drain electrode of the thin film transistor TR.

The common electrode CE may be disposed (e.g., entirely disposed) on the second substrate 412. However, the inventive concept is not limited thereto, and the common electrode CE may be disposed on the first substrate 411. In this case, at least one of the pixel electrode PE and the common electrode CE may include a slit, and a horizontal field may be formed at the liquid crystal layer LC.

The storage capacitor Cst may include the pixel electrode PE, a storage electrode branched from a storage line, and a dielectric layer disposed between the pixel electrode PE and the storage electrode. At least a portion of the storage electrode may overlap with the pixel electrode PE, with the dielectric layer therebetween. The storage line may be disposed on the first substrate 411 and formed on the same layer as the gate lines GL1 to GLn (e.g., formed concurrently or simultaneously with the gate lines GL1 to GLn).

The sub pixel SPX may further include a color filter CF for transmitting light having a wavelength corresponding to a specific color. For example, the color filter CF may be disposed on the second substrate 412. However, the inventive concept is not limited thereto, and the color filter CF may be disposed on the first substrate 411.

The thin film transistor TR is turned on in response to a gate signal provided through the first gate line GL1. A data voltage provided through the first data line DL1 is provided to the pixel electrode PE of the liquid crystal capacitor Clc through the turned-on thin film transistor TR. A common voltage is applied to the common electrode CE.

A field is formed between the pixel electrode PE and the common electrode CE by a difference in voltage level between the data voltage and the common voltage. The liquid crystal molecules of the liquid crystal layer LC are driven by the field formed between the pixel electrode PE and the common electrode CE. The light transmittance of the sub pixel SPX may be adjusted by the liquid crystal molecules driven by the field formed, thus an image may be displayed.

A storage voltage having a voltage level (e.g., a predetermined, certain, or set voltage level) may be applied to the storage line. However, the inventive concept is not limited thereto, and the storage line may receive the common voltage. The storage capacitor Cst maintains or substantially maintains a charged voltage in the liquid crystal capacitor Clc.

Figure 3:
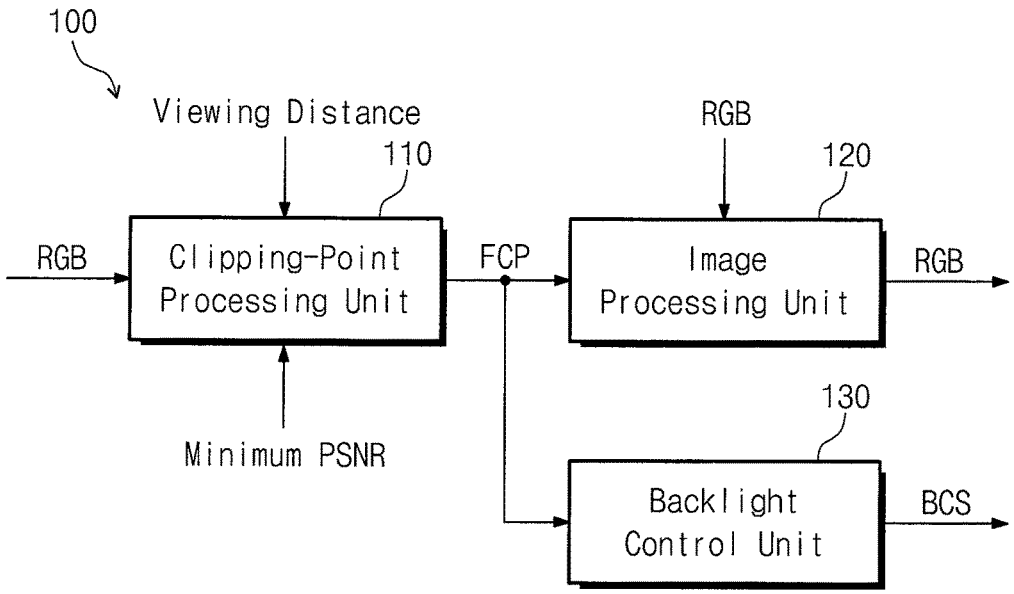
FIG. 3 is a schematic block diagram of a control unit in FIG. 1.

FIG. 3 is a schematic, block diagram of a control unit in FIG. 1.

Referring to FIG. 3, the control unit (e.g., controller) 100 includes a clipping point processing unit (e.g., a clipping point processor) 110, an image processing unit (e.g., an image processor) 120, and a backlight control unit (e.g., a backlight controller) 130.

The clipping point processing unit 110 may generate a final clipping point FCP based on the input image data RGB, the viewing distance, and a minimum peak signal noise ratio (PSNR). A method of generating the final clipping point FCP is described in detail with reference to FIGS. 4 and 5.

The control unit 100 performs dimming by using the final clipping point FCP. For example, the final clipping point FCP is the reduced maximum gray scale value of a dimming image. The control unit 100 decreases the luminance of backlight of the backlight unit (see FIG. 1) based on the final clipping point FCP. Also, in order to compensate for the reduced backlight luminance, the light transmittance of the pixels PX (see FIG. 1) of the display panel 400 (see FIG. 1) increases.

The backlight control unit 130 receives the final clipping point FCP and generates the backlight control signal BCS based on the final clipping point FCP. Also, the backlight control unit 130 adjusts the luminance of backlight through the backlight control signal BCS.

The image processing unit 120 receives the final clipping point FCP and the input image data RGB, converts the input image data RGB into the output image data RGB' based on the final clipping point FCP, and adjusts the light transmittance of the pixels PX of the display panel 400 through the output image data RGB'.

For example, when the maximum gray scale value is 255 and the final clipping point FCP corresponds to a gray scale value of 220, the luminance of the backlight decreases by about 86%=220/255100. When any one pixel data has a value corresponding to a gray scale of x1 lower than the final clipping point FCP, the transmittance of the pixels PX is x1/220100%. Also, when any one pixel data has a value corresponding to a gray scale value of x2 higher than the final clipping point FCP, the transmittance of the pixels PX is 100% and an image deteriorates.

The light transmittance of the pixels PX may increase by about 115%=255/220100. As a result, power consumption may decrease by the decreased backlight luminance.

The smaller the final clipping point FCP is, the more the luminance of backlight decreases, so power consumed by the backlight unit 500 (see FIG. 1) decreases but an image displayed on the display panel 400 deteriorates. For example, since high gray scale images having gray scales values higher than the final clipping point FCP are displayed with lower gray scales lower than original gray scale values, the image quality of the high gray scale images deteriorates. As such, processing pixel data to enable the pixels PX to display an image having a lower gray scale value than the original by the final clipping point FCP is referred to as "clipping pixel data".

In the present example, the pixel data refers to data that forms the input image data RGB and/or the output image data RGB'. The pixel data may correspond to the pixels PX and may include information on unit image to be displayed by the pixels PX, respectively.

Figure 4:
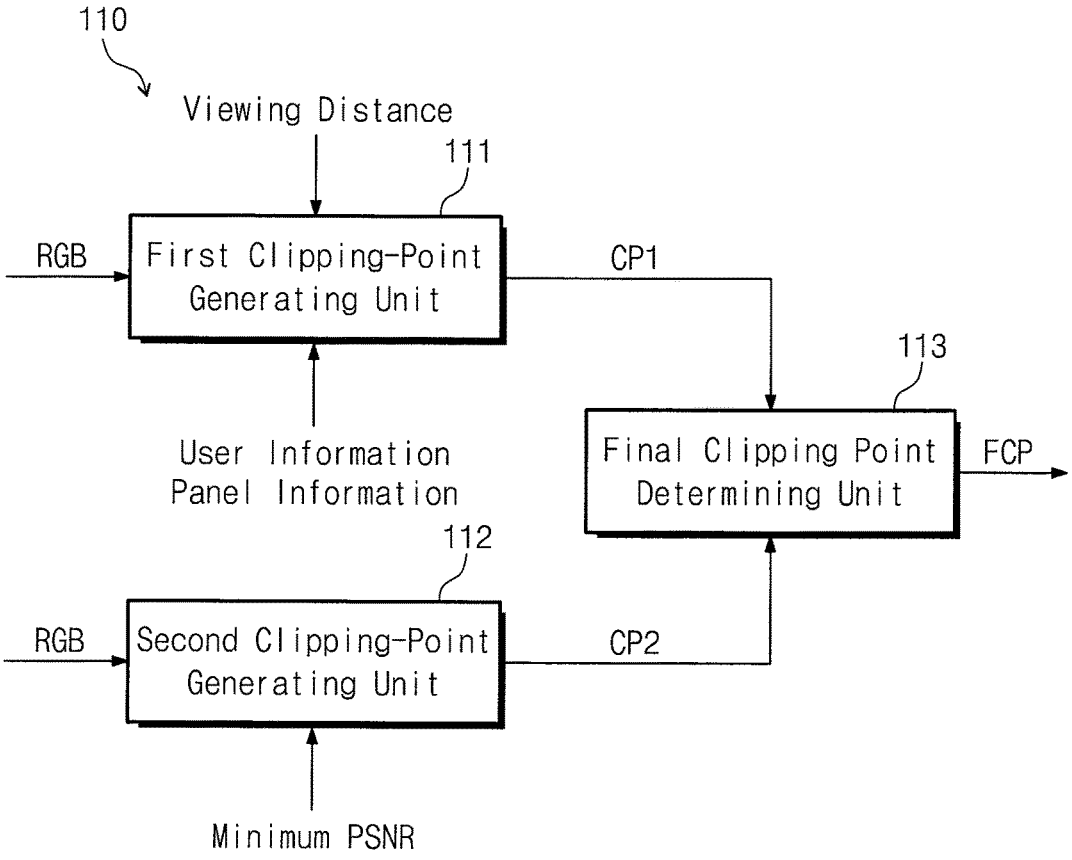
FIG. 4 is a schematic block diagram of a clipping point processing unit in FIG. 3.
Figure 5:
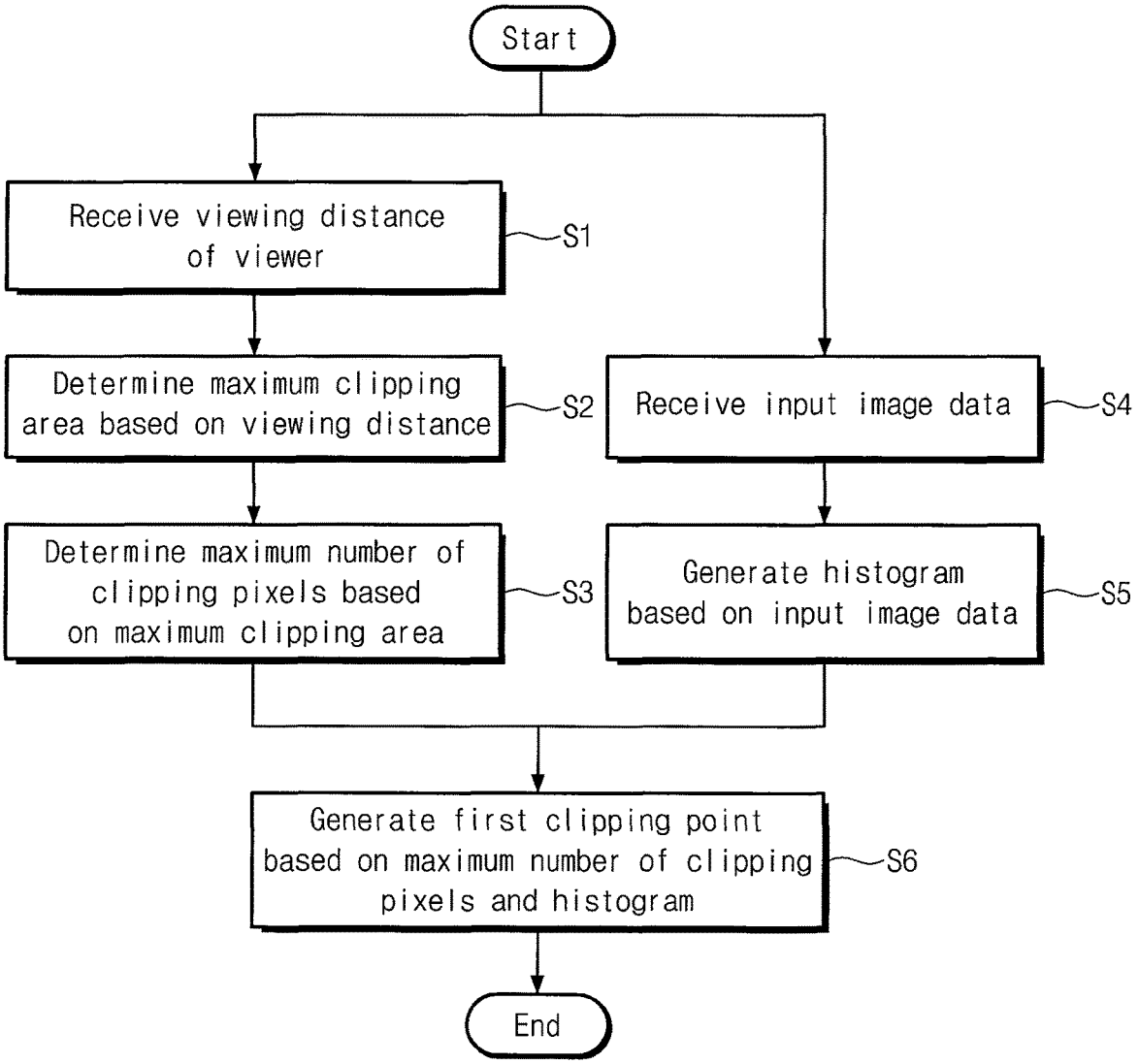
FIG. 5 is a flowchart illustrating the operation of a first clipping point generating unit in FIG. 4.
Figure 6:
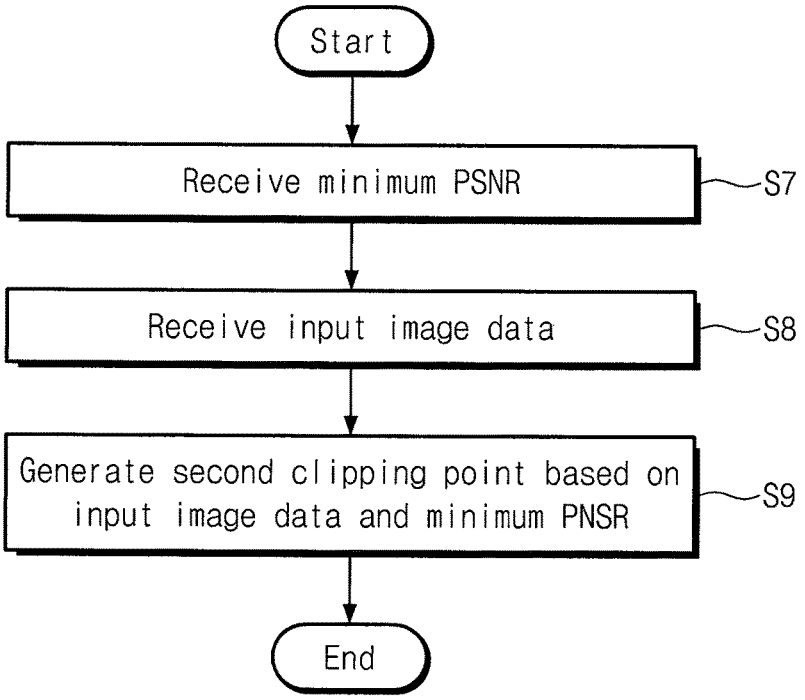
FIG. 6 is a flowchart illustrating the operation of a second clipping point generating unit in FIG. 4.
Figure 7:
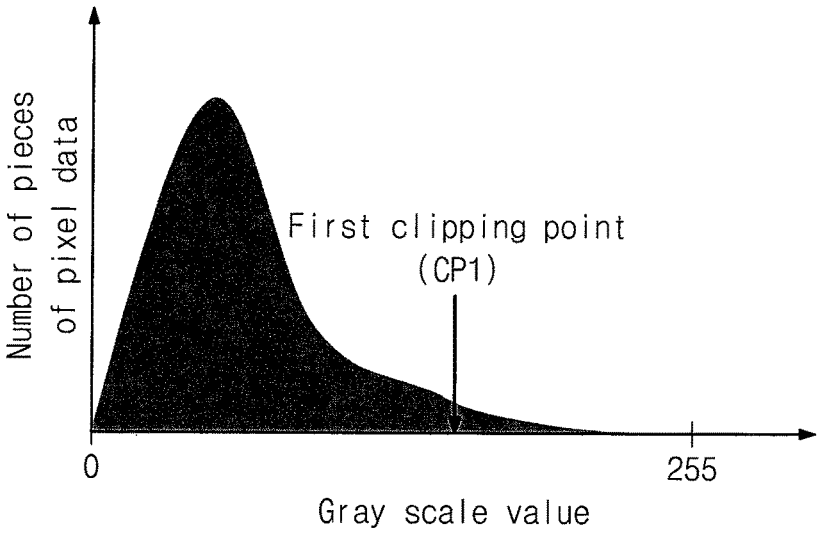
FIG. 7 is a histogram generated according to an embodiment of the inventive concept.

FIG. 4 is a schematic block diagram of the clipping point processing unit in FIG. 3, FIG. 5 is a flowchart illustrating the operation of a first clipping point generating unit in FIG. 4, FIG. 6 is a flowchart illustrating the operation of a second clipping point generating unit in FIG. 4, and FIG. 7 is a histogram generated according to an embodiment of the inventive concept.

Referring to FIG. 4, the clipping point processing unit 110 includes a first clipping point generating unit (e.g., a first clipping point generator) 111, a second clipping point generating unit (e.g., a second clipping point generator) 112, and a final clipping point determining unit (e.g., a final clipping point determiner) 113.

Referring further to FIG. 5, the first clipping point generating unit 111 receives the viewing distance at block S1. Also, the first clipping point generating unit 111 receives the input image data RGB, panel information including the specification of the display panel 400 (see FIG. 1), and user information. The user information may include, for example, information on image quality that a viewer prefers and/or information on viewer's sensitiveness to the deterioration of image quality. The panel information may include, for example, information on the size, area, and/or resolution of the display panel 400.

The panel information and the user information may be pre-set and/or stored in a memory by, for example, a viewer and/or the first clipping point generating unit 111, and may be selected and loaded by the viewer and/or the first clipping point generating unit 111.

The first clipping point generating unit 111 determines a maximum clipping area based on the viewing distance of the viewer at block S2.

As described above, when dimming is performed, a displayed image may deteriorate. The deterioration of an image perceived by the viewer may depend on an area on which the deterioration of the image occurs, for example, a deterioration area. In other words, as the deterioration area widens, the deterioration of the image may be more easily perceived, and as the deterioration area narrows, the viewer may not perceive the deterioration of the image. Also, such a deterioration area may be perceived by the viewer according to the viewing distance. Thus, even with the same deterioration area, the deterioration of an image may be more easily perceivable by a viewer the shorter the viewing distance is, while the deterioration of the image may be less perceivable by the viewer the longer the viewing distance is.

The maximum clipping area is the maximum area of the deterioration area that the viewer may not perceive according to the viewing distance. In other words, based on the current viewing distance of the viewer, a deterioration area having an area smaller than the maximum clipping area may not be perceived by the viewer, and a deterioration area having an area larger than the maximum clipping area may be perceived by the viewer.

In another example of the inventive concept, the maximum clipping area may be modified by a user. For example, in order to decrease the power consumption of the display apparatus, the viewer may modify the maximum clipping area so that the maximum clipping area corresponds to the maximum area of a deterioration area that the viewer may not perceive according to a specific viewing distance. In this case, the viewer may sacrifice the image quality of an image within an acceptable range to decrease the power consumption of the display apparatus. The maximum clipping area widens according to the viewing distance. As an example of the inventive concept, the maximum clipping area may be proportional to the square of the viewing distance.

That is, the maximum clipping area may satisfy Equation (1):

$$CAmax = CAnorm \times D^2 \quad (1)$$

where CAmax refers to the maximum clipping area, D refers to the viewing distance, and CAnorm refers to a normalized maximum clipping area.

However, the inventive concept is not limited thereto, for example, the maximum clipping area may be proportional to the viewing distance or to the logarithm of the viewing distance.

The normalized maximum clipping area may be a maximum clipping area when the viewing distance is about 1 m. The degree in which a deterioration image is perceived may vary according to the viewer. Thus, the normalized maximum clipping area may be determined based on the viewer information to be suitable for each viewer. The viewer information that is a basis for determining the normalized maximum clipping area may be selected by the viewer and/or the first clipping point generating unit 111.

When the maximum clipping area is determined, the first clipping point generating unit 111 determines the maximum number of clipping pixels based on the maximum clipping area and the panel information at block S3. For example, the first clipping point generating unit 111 uses the panel information to calculate the number of pixels that may be included in the maximum clipping area. In more detail, the first clipping point generating unit 111 may determine the number of pixels per unit area by using the panel information, and may determine the maximum number of clipping pixels based on the number of pixels per unit area and the maximum clipping area. As an example of the inventive concept, the maximum number of clipping pixels may satisfy Equation (2) below:

$$Nmax = CAmax \times PDA \quad (2)$$

where Nmax refers to the maximum number of clipping pixels, CAmax refers to the maximum clipping area and PDA refers to the number of pixels per unit area of the display panel 400.

The first clipping point generating unit 111 receives the input image data RGB at block S4. To this end, the histogram in FIG. 7 is generated based on the gray scale values of the input image data RGB at block S5. In more detail, the x axis of the histogram represents a gray scale value and the y axis of the histogram represents the number of plurality of pixel data of the input image data each having a gray scale value. As an example of the inventive concept, the first clipping point generating unit 111 may generate the histogram at every interval corresponding to at least one frame.

Then, in order to prevent or reduce the deterioration of image quality, the first clipping point generating unit 111 may generate a first clipping point CP1 based on the histogram and the maximum number of clipping pixels, so that only pixel data corresponding to the maximum number of clipping pixels is clipped, at block S6. For example, the first clipping point satisfies Equation (3) below:

$$Ncp(g) = \sum_{k=g}^{255} Hist(k) \quad (3)$$

$$Ncp(g) < Nmax$$

where Ncp (g) refers to the number of plurality of pixel data of the input image data RGB clipped when the first clipping point CP1 has a gray scale value of g, Hist(k) refers to the number of plurality of pixel data corresponding to a gray scale value of k, and Nmax refers to the maximum number of clipping pixels.

When the first clipping point CP1 is determined by using Equation (3), the number of plurality of pixel data having a gray scale value greater than or equal to the first clipping point CP1 is less than the maximum number of clipping pixels, as shown in FIG. 7.

Referring further to FIG. 6, the second clipping point generating unit 112 receives the minimum PSNR at block S7.

The PSNR is a value used for quantifying the difference between two images when images are processed. The PSNR may be defined by e.g., Equation (4) below:

$$MSE = \frac{1}{m}\sum_{k=1}^{m}(x_k - y_k)^2 \quad (4)$$

$$PSNR = 10\log_{10}\left(\frac{255^2}{MSE}\right)$$

where MSE refers to Mean Square Error (MSE), m refers to the total number of plurality of pixel data of the input image data, and xk and yk respectively refer to a gray scale value of kth pixel data of the input image data RGB and a gray scale value of kth pixel data after the input image data RGB is processed.

The minimum PSNR may be preset to prevent or substantially prevent an image from deteriorating beyond a certain level due to dimming and clipping not exceeding a certain level. As an example of the inventive concept, the minimum PSNR may be set to about 20 dB.

Then, the second clipping point generating unit 112 receives the input image data RGB at block S8, and generates a second clipping point CP2 based on the minimum PSNR and the input image data RGB at block S9.

For example, the second clipping point generating unit 112 determines temporary clipping points and calculates a temporary PSNR generated when the pixel data of the input image data RGB is processed, by using the temporary clipping point. Then, the temporary clipping points corresponding to temporary PSNRs having a greater value than the minimum PSNR from among the temporary PSNRs are determined, and a temporary clipping point having the smallest value from among the temporary clipping points is determined to be the second clipping point CP2. In one embodiment Equation (4) above may be used in order to calculate the temporary PSNRs.

However, when Equation (4) above is used, many calculations may be performed. Thus, by using Equation (5) below, the second clipping point CP2 may be determined more simply.

For example, the second clipping point generating unit 112 may extract a maximum gray scale value from the plurality of pixel data of the input image data RGB, and may generate a maximum clipping level based on the minimum PSNR. Then, the second clipping point generating unit 112 may determine the second clipping point CP2 based on the maximum gray scale value and the maximum clipping level. For example, the second clipping point generating unit 112 may determine the second clipping point CP2 by using Equation (5) below:

$$CP2 - MGV - MCL \tag{5}$$

$$MOL = \left( \frac{256}{10^{\frac{PSNR_{Min}}{20}}} \right)$$

where MGV refers to the maximum of the gray scale values of the input image data RGB, MCL refers to a maximum clipping level, and $PSNR_{Min}$ refers to the minimum PSNR. The second clipping point CP2 may prevent or substantially prevent pixel data from becoming clipped to be greater than or equal to the maximum clipping level, thereby preventing or reducing serious image deterioration due to dimming.

The final clipping point determining unit 113 receives the first clipping point CP1 from the first clipping point generating unit 111 and receives the second clipping point CP2 from the second clipping point generating unit 112, as shown in FIG. 4. The final clipping point determining unit 113 may generate the final clipping point FCP based on the first and second clipping points CP1 and CP2.

As an example of the inventive concept, the final clipping point determining unit 113 may compare the first and second clipping points CP1 and CP2 with each other, and may select any one of the first and second clipping points CP1 and CP2. For example, the final clipping point determining unit 113 may select the second clipping point CP2 when the first clipping point CP1 is smaller than the second clipping point CP2, and may select the first clipping point CP1 when the first clipping point CP1 is greater than the second clipping point CP2. The final clipping point determining unit 113 may generate a clipping point selected from among the first and second clipping points CP1 and CP2 as the final clipping point FCP.

However, the inventive concept is not limited thereto, and the final clipping point determining unit 113 may generate the final clipping point FCP by using various suitable methods based on the first and second clipping points CP1 and CP2. For example, the final clipping point determining unit 113 may use the average value of the first and second clipping points CP1 and CP2, and/or values obtained by adding different weights to the first and second clipping points CP1 and CP2, respectively.

In summary, the clipping point processing unit 110 uses a maximum clipping area based on the viewing distance in order to find the final clipping point FCP. Also, in order to reflect an image deterioration variation according to a panel and a viewer, the clipping point processing unit 110 uses the panel information and user information for finding the final clipping point FCP. Thus, since it is possible to decrease the luminance of the backlight as much as possible within a range in which a viewer may not actually perceive image deterioration, the power consumption of the backlight unit 500 (in FIG. 1) decreases.

Also, since the minimum PNSR is used to prevent or substantially prevent an image from deteriorating beyond a certain level, serious image deterioration is prevented or reduced.

Global dimming in which an entirety of the backlight corresponding to an image being displayed is dimmed has been described above. However, the inventive concept is not limited thereto, and in some embodiments, block dimming may be applied as will be described below. In the following, block dimming according to some embodiments of the inventive concept is described with reference to FIGS. 8 to 14.

Figure 8:
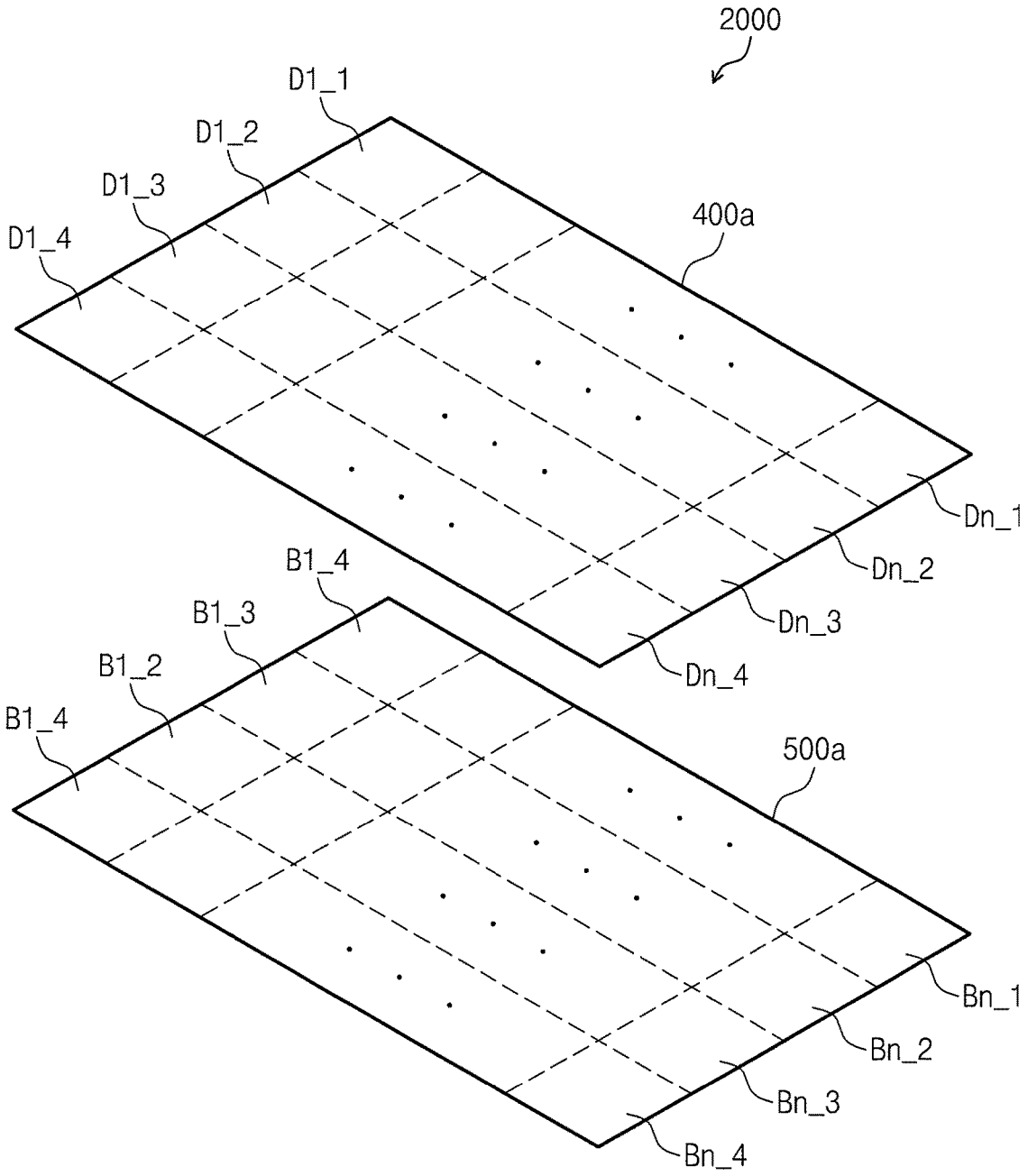
FIG. 8 is a schematic perspective view of a display apparatus according to another embodiment of the inventive concept.

FIG. 8 is a schematic perspective view of a display apparatus according to another embodiment of the inventive concept.

The display apparatus of FIG. 8 may be driven with blocking dimming and includes a display panel 400*a* and a backlight unit (or backlight) 500*a*.

The display panel 400*a* may have a 2D dimming structure. In other words, the display panel 400*a* may have dimming areas D1_1 to Dn_4 obtained by dividing the display panel 400*a* in two different directions. As an example of an embodiment of the inventive concept, the dimming areas D1_1 to Dn_4 may be formed in a 4×n matrix structure. Although for convenience of description, FIG. 8 shows that the matrix structure defined by the dimming areas D1_1 to Dn_4 has four rows, the inventive concept is not limited thereto.

The backlight unit 500*a* may include a plurality of light source blocks B1_1 to Bn_4 that are arranged to correspond 1:1 to the dimming areas D1_1 to Dn_4. The light source blocks B1_1 to Bn_4 are respectively arranged to correspond to the dimming areas D1_1 to Dn_4, and each of the light source blocks B1_1 to Bn_4 supplies backlight to a corresponding dimming area.

Figure 9:
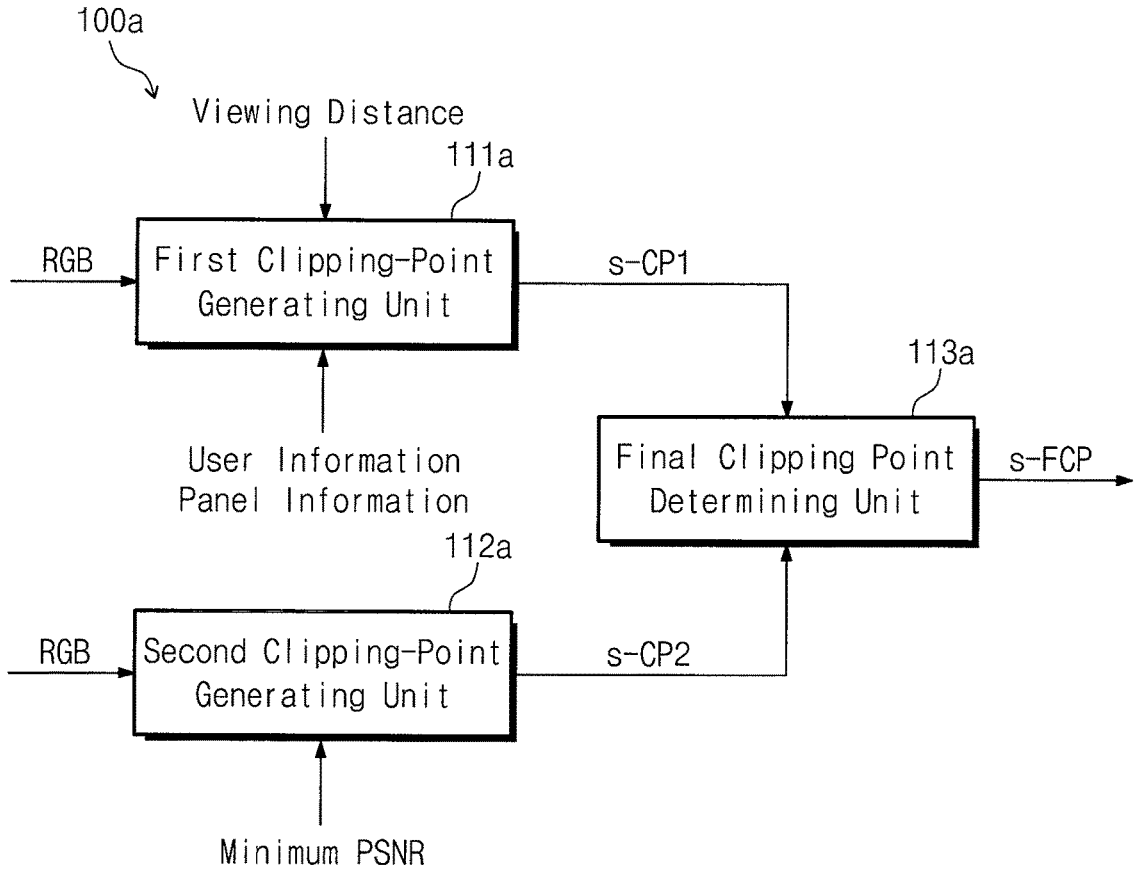
FIG. 9 is a schematic block diagram of a clipping point processing unit according to another embodiment of the inventive concept.
Figure 10:
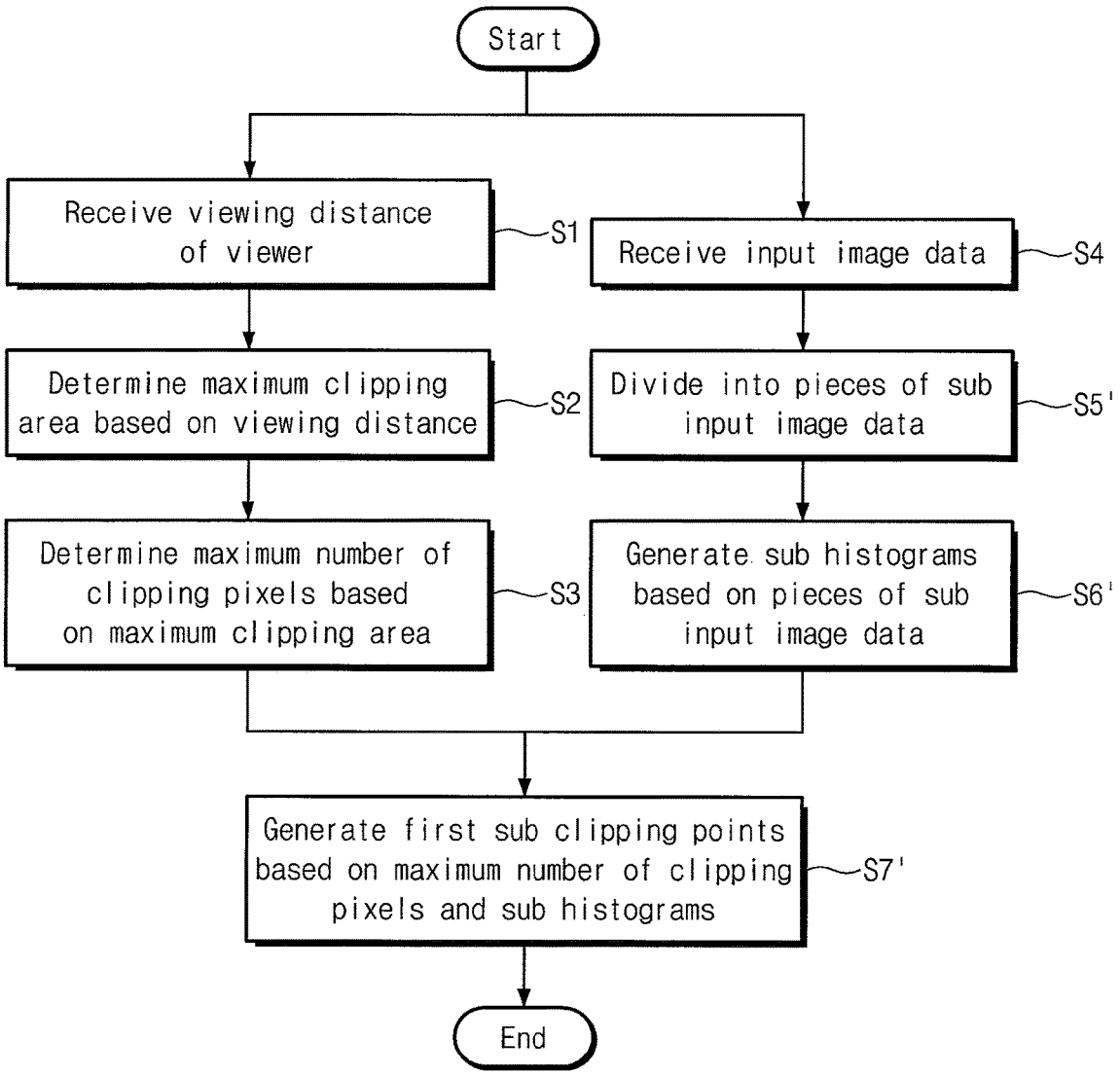
FIG. 10 is a flowchart illustrating the operation of a first clipping point generating unit in FIG. 9.

FIG. 9 is a schematic block diagram of a clipping point processing unit according to another embodiment of the inventive concept, and FIG. 10 is a flowchart illustrating the operation of a first clipping point generating unit in FIG. 9.

Referring to FIG. 9, a clipping point processing unit (e.g., a clipping point processor) 110*a* according to another embodiment of the inventive concept includes a first clipping point generating unit (e.g., a first clipping point generator) 111*a*, a second clipping point generating unit (e.g., a second clipping point generator) 112*a*, and a final clipping point determining unit (e.g., a final clipping point determiner) 113*a*.

In the following, related descriptions are provided with reference to FIGS. 9 and 10. Since blocks S1 to S4 have been described with reference to FIG. 5, related descriptions thereof may be omitted.

The first clipping point generating unit 111*a* divides the input image data RGB into a plurality of sub input image data at block S5'. The plurality of sub input image data may correspond to the dimming areas D1_1 to Dn_4, respectively.

Then, the first clipping point generating unit 111*a* generates a plurality of sub histograms based on the gray scale values of the plurality of sub input image data at block S6'. The sub histograms are the histograms of the dimming areas D1_1 to Dn_4, respectively.

For example, the x axis of each of the histograms represents a gray scale value and the y axis of each of the histograms represents the number of plurality of pixel data of the input image data corresponding to each gray scale value. As an example of the inventive concept, the first clipping point generating unit 111*a* may generate the sub histograms at every interval corresponding to at least one frame. Each of the sub histograms may be generated in the same or substantially the same way as the histogram in FIG. 7, for example.

Then, the first clipping point generating unit 111*a* generates a plurality of first sub clipping points s-CP1 at block S7'. The first sub clipping points s-CP1 correspond to the dimming areas D1_1 to Dn_4 (see FIG. 8), respectively. For example, the first clipping point generating unit 111*a* may generate the first sub clipping points s-CP1 based on the sub histograms and the maximum number of clipping pixels for each of the dimming areas D1_1 to Dn_4, so that only pixel data corresponding to the maximum number of clipping pixels is clipped. Each of the first sub clipping points s-CP1 may satisfy Equation (3) as described above.

Figure 11:
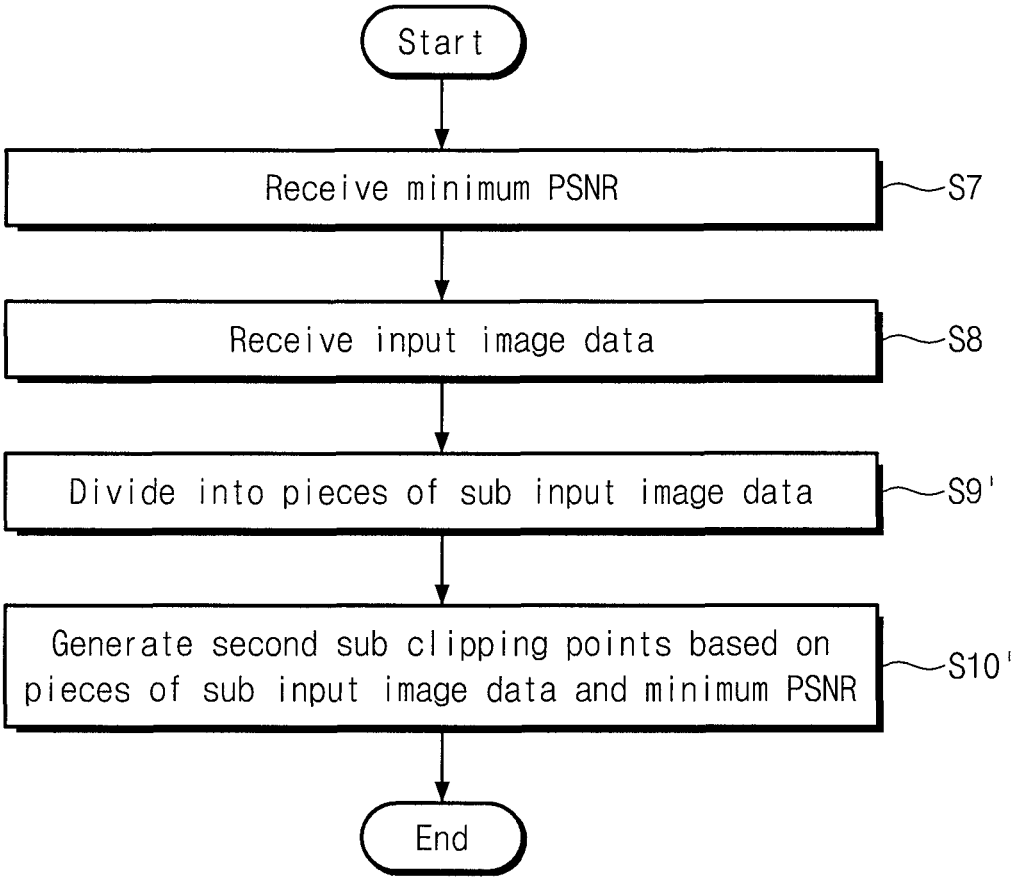
FIG. 11 is a flowchart illustrating the operation of a second clipping point generating unit in FIG. 9.
Figure 12:
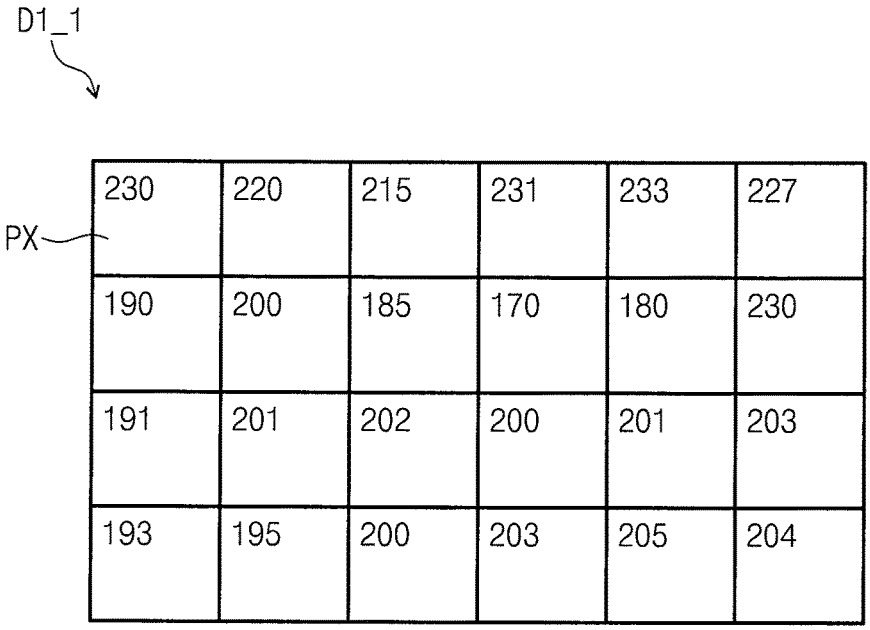
FIG. 12 is an enlarged plan view of a dimming area according to an embodiment of the inventive concept.
Figure 13:
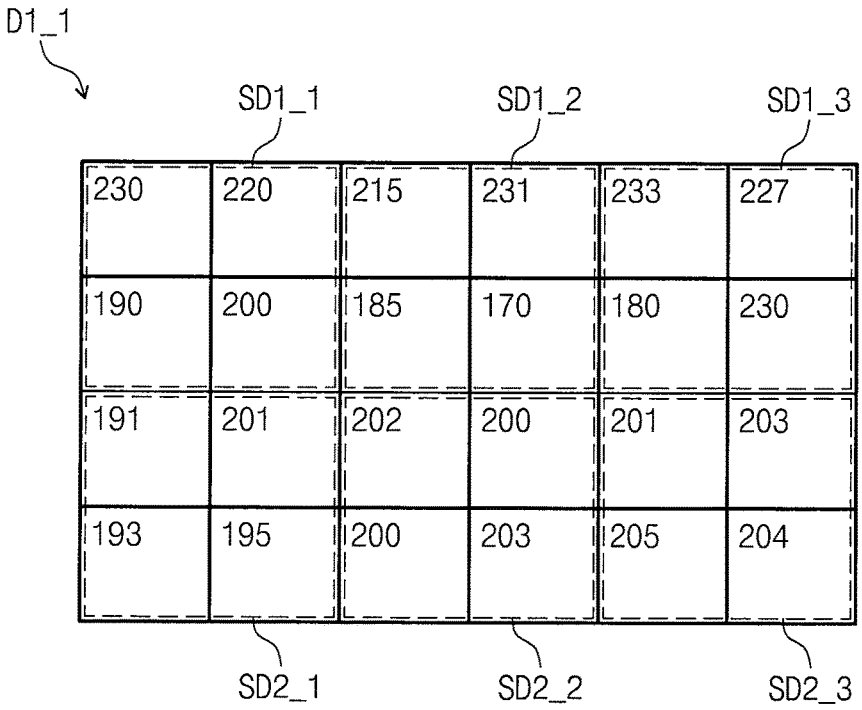
FIG. 13 is an enlarged plan view of a dimming area according to another embodiment of the inventive concept.

FIG. 11 is a flowchart illustrating the operation of a second clipping point generating unit (e.g., a second clipping point generator) in FIG. 9, FIG. 12 is an enlarged plan view of a dimming area according to an embodiment of the inventive concept, and FIG. 13 is an enlarged plan view of a dimming area according to another embodiment of the inventive concept.

Referring to FIGS. 9 and 11, the second clipping point generating unit 112*a* receives the minimum PSNR and the input image data RGB at blocks S7 and S8. Since blocks S7 and S8 have been described with reference to FIG. 6, related descriptions thereof are omitted.

Subsequently, the second clipping point generating unit 112*a* divides the input image data RGB into the plurality of sub input image data at block S9'. In another embodiment, the second clipping point generating unit 112*a* may receive the plurality of sub input image data that has been previously divided.

The second clipping point generating unit 112*a* generates a plurality of second sub clipping points s-CP2 based on the minimum PSNR and the sub input image data at block S10'. The second sub clipping points s-CP2 may correspond to the dimming areas D1_1 to Dn_4 (see FIG. 8), respectively.

For example, the second clipping point generating unit 112*a* determines temporary clipping points and calculates a temporary PSNR of each of the dimming areas D1_1 to Dn_4 generated when the pixel data of the plurality of sub input image data is processed, by using the temporary clipping points. Then, a temporary clipping point of each of the dimming areas D1_1 to Dn_4 corresponding to temporary PSNRs having a greater value than the minimum PSNR from among the temporary PSNRs is determined, and a temporary clipping point having the smallest value from among the temporary clipping points is determined to be the second sub clipping point s-CP2 of each of the dimming areas D1_1 to Dn_4. It is possible to use Equation (4) in order to calculate the temporary PSNRs.

However, when Equation (4) is used as above, many calculations may be performed. Thus, it is possible to more simply determine the second sub clipping points s-CP2 of each of the dimming areas D1_1 to Dn_4 by using Equation (5) as described above.

For example, the second clipping point generating unit 112*a* generates a block reference value for each of the plurality of sub input image data from the plurality of input image data RGB, and generates the maximum clipping level of each of the dimming areas D1_1 to Dn_4 based on the minimum PSNR.

As an example of the inventive concept, the block reference values may respectively be the maximum gray scale values of the plurality of sub input image data. For example, the plurality of pixel data having different gray scale values are provided to pixels PX, which are arranged in a 4×6 matrix structure, as shown in FIG. 12. In this case, the block reference value of the dimming area D1_1 is 233, which is the maximum gray scale value of the plurality of sub input image data corresponding to the dimming area D1_1.

Then, the second clipping point generating unit 112*a* may determine the second sub clipping points s-CP2 based on the maximum gray scale values of the plurality of sub input image data and the maximum clipping level. In this case, the second clipping point generating unit 112*a* may determine the second sub clipping point s-CP2 by using Equation (5) as described above.

According to another embodiment of the inventive concept, the block reference values may be generated based on a plurality of sub dimming areas obtained by dividing each of the dimming areas D1_1 to Dn_4. For example, the dimming area D1_1 may include sub dimming areas SD1_1 to SD2_3 arranged in a 2×3 matrix structure. The second clipping point generating unit 112*a* determines the average gray scale value of the sub dimming areas SD1_1 to SD2_3. For example, the average gray scale value of the sub dimming area SD1_1 of a first row and a first column is 210=(230+220+190+200)/4. The average gray scale values of the sub dimming areas SD1_2 to SD2_3 are 200.25, 217.5, 195, 201.25, and 203.25. Then, the second clipping point generating unit 112*a* generates 217.5, which is the maximum of the average gray scale values of the sub dimming areas SD1_1 to SD2_3 as the block reference value of the dimming area D1_1. As such, by using the average gray scale values of the sub dimming areas, it is possible to prevent or substantially prevent the block reference values of the dimming areas D1_1 to Dn_4 from being determined inappropriately by pixel data having a high gray scale value.

Then, the final clipping point determining unit 113*a* receives the first sub clipping points s-CP1 from the first clipping point generating unit 111*a* and receives the second sub clipping point s-CP2 from the second clipping point generating unit 112*a*. Based on the first and second sub clipping points s-CP1 and s-CP2, it is possible to generate a plurality of sub final clipping points of the final clipping point FCP.

As an example of the inventive concept, the final clipping point determining unit 113*a* may compare each of the first sub clipping points s-CP1 with the second sub clipping point s-CP2, and may select any one of the first and second sub clipping points used for the comparison. For example, the final clipping point determining unit 113*a* selects the second sub clipping point s-CP2 of the dimming area D1_1 when the first sub clipping point s-CP1 of the dimming area D1_1 is smaller than the second sub clipping point s-CP2 of the dimming area D1_1, and selects the first sub clipping point s-CP1 when the first sub clipping point s-CP1 of the dimming area D1_1 is greater than the second sub clipping point s-CP2.

The final clipping point determining unit 113*a* generates clipping points selected from among the first and second sub clipping points s-CP1 and s-CP2 as the sub final clipping points. Thus, the sub final clipping points satisfy Equation (6) below:

$$FCP(i,j)=\max\{CP1(ij),CP2(i,j)\} \quad (6)$$

where FCP(i,j), CP1(*i*,*j*), and CP2(*i*,*j*) are sub final clipping points, and a first sub clipping point and a second sub clipping point correspond to the dimming area of an ith row and a jth column.

In summary, the clipping point processing unit 110*a* uses a maximum clipping area based on the viewing distance in order to find the sub final clipping point s-FCP. Also, in order to reflect an image deterioration variation according to a panel and a viewer, the panel information and the user information are used for finding the sub final clipping point s-FCP. Thus, since it is possible to decrease the luminance of the backlight as much as possible within a range in which a viewer may not actually perceive an image deterioration, the power consumption of the backlight unit 500*a* decreases.

Also, since a minimum PNSR is used in order to prevent or substantially prevent image deterioration from exceeding a certain level, serious image deterioration is prevented or reduced. Also, by analyzing an image on each of the dimming areas D1_1 to Dn_4 and generating the sub final clipping points of the dimming areas D1_1 to Dn_4, it is possible to decrease power consumption and improve image quality. In particular, when there is a big difference in average gray scale values between the dimming areas D1_1 to Dn_4, the final clipping point of dimming areas showing a relatively high average gray scale is set to be high, and the final clipping point of dimming areas showing a relatively low average gray scale is set to be low, and thus, it may be possible to decrease power consumption and improve image deterioration.

Figure 14A:
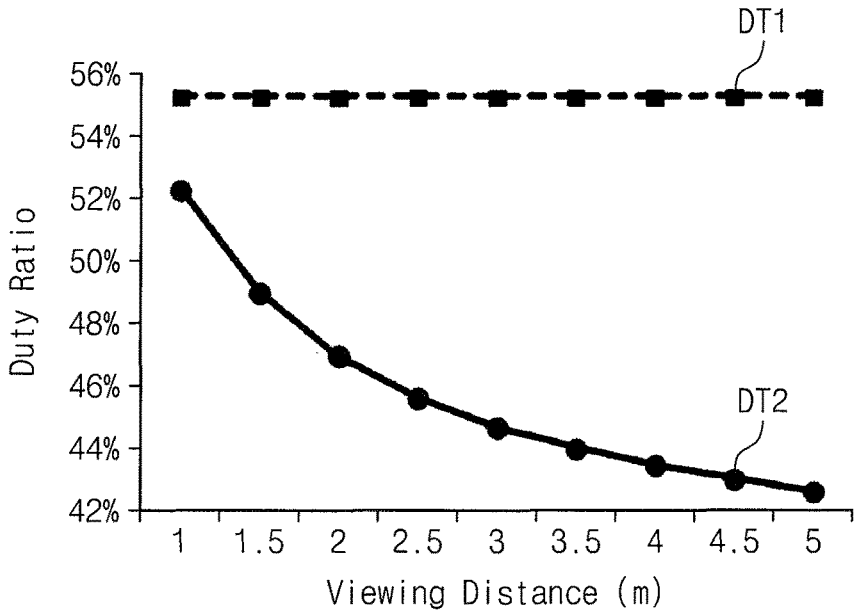
FIG. 14A is a graph showing the duty ratio of a backlight unit in FIG. 8.
Figure 14B:
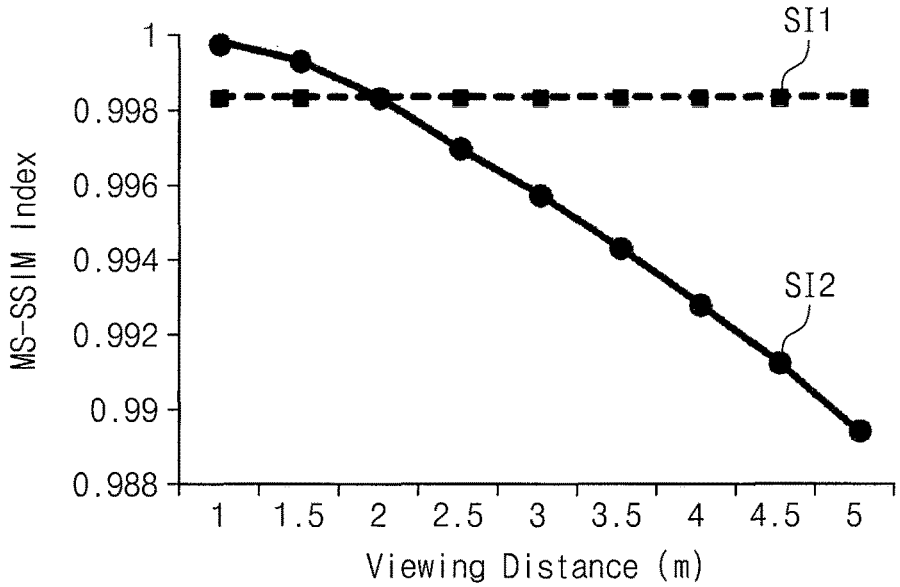
FIG. 14B is a graph showing the multi-scale structural similarity (MS-SSIM) index of a display apparatus in FIG. 8.
Figure 14C:
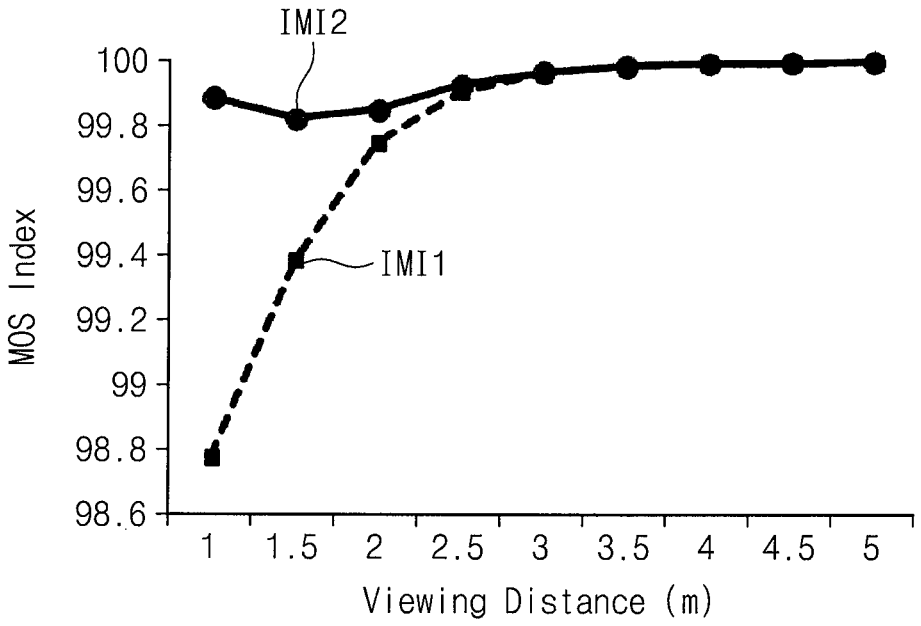
FIG. 14C is a graph showing the means opinion score (MOS) index of the display apparatus in FIG. 8.

FIG. 14A is a graph showing the duty ratio of a backlight unit in FIG. 8, FIG. 14B is a graph showing the MS-SSIM index of a display apparatus in FIG. 8, and FIG. 14C is a graph showing the means opinion score (MOS) index of the display apparatus in FIG. 8.

As shown in FIG. 14A, the x axis of the graph of FIG. 14A represents a viewing distance and the y axis represents the duty ratio of the backlight unit 500*a* (see FIG. 8). The greater the duty ratio is, the more the luminance of the backlight and the power consumption of the backlight unit 500*a* increases.

A first duty ratio DT1 of FIG. 14A is a duty ratio according to the viewing distance of another display apparatus. The other display apparatus is a display apparatus using a high performance local dimming (HPLD) algorithm and is presented in order to compare it with the performance of the display apparatus 2000 (of FIG. 8) according to an embodiment of the inventive concept. The other display apparatus is disclosed in "High-Performance Local Dimming Algorithm and Its Hardware Implementation for LCD Backlight," Journal of Display Technology, vol. 9, no. 7, pp. 527-535, July 2013". A second duty ratio DT2 is a duty ratio according to the viewing distance of a display apparatus according to an embodiment of the inventive concept.

As shown in FIG. 14A, the first duty ratio DT1 maintains a constant value even though the viewing distance is increased. However, the second duty ratio DT2 decreases as the viewing distance increases, and the second duty ratio DT2 has a functional relation inversely proportional to the viewing distance. For example, at a distance of about 5 m, the first duty ratio DT1 has a value of about 55%, and the second duty ratio DT2 has a value of about 42%. When the first and second duty ratios DT1 and DT2 are compared, the power consumption of the display apparatus 2000 according to an embodiment of the inventive concept may decrease by about 3% to about 15% when compared to that of the other display apparatus.

As shown in FIG. 14B, the x axis of the graph of FIG. 14B represents a viewing distance and the y axis represents an MS-SSIM index. A multi-scale structural similarity (MS-SSIM) index compares structural information (e.g., the average of luminance, the deviation of luminance, and so on) between an original image and a dimmed image to evaluate image quality. The MS-SSIM index has a value between 0 and 1, and the greater its value the higher the similarity is between the two images.

A first similarity index SI1 represents an MS-SSIM index according to the viewing distance of the other display apparatus, and a second similarity index SI2 represents an MS-SSIM index according to the viewing distance of the display apparatus 2000 according to an embodiment of the inventive concept.

As shown in FIG. 14B, the first similarity index SI1 maintains or substantially maintains a constant value, even though the viewing distance increases. On the other hand, the second similarity index SI2 decreases according to the viewing distance. When the viewing distance is shorter than about 2m, the MS-SSIM index of the display apparatus 2000 is higher than that of the other display apparatus.

As shown in FIG. 14C, the x axis of the graph of FIG. 14C represents a viewing distance and the y axis represents a mean opinion score (MOS) index. The MOS index evaluates the difference between an original image and a dimming image that may be perceived by a viewer. The MOS index reflects a resolution, a viewing distance, the size of a display panel, and so on as parameters. The MOS index has a value between 0 and 100, and as the value of the MOS index of an image increases, the higher the perceived image quality by a viewer.

A first image quality index IMI1 represents a MOS index according to the viewing distance of the other display apparatus, and a second image quality index IMI2 represents a MOS index according to the viewing distance of the display apparatus 2000 according to an embodiment of the inventive concept.

As shown in FIG. 14C, the first image quality index IMI1 increases as the viewing distance increases. On the other hand, the second image quality index IMI2 has a constant or substantially constant value according to the viewing distance. Since the MOS index of the display apparatus 2000 is constant or substantially constant according to the viewing distance, a viewer may not perceive the deterioration of an image, even though the power consumption of the backlight unit 500*a* decreases by changing the final clipping point according to the viewing distance. For example, when the viewing distance is shorter than about 3 m, the MOS index of the display apparatus 2000 is higher than that of the other display apparatus. Thus, the display apparatus 2000 may provide a more appropriate clipping point when compared to that of the other display apparatus.

In summary, although the display apparatus 2000 provides the same or better image quality than that of the other display apparatus, the power consumption of the display apparatus 2000 is lower than that of the other display apparatus.

Figure 15A:
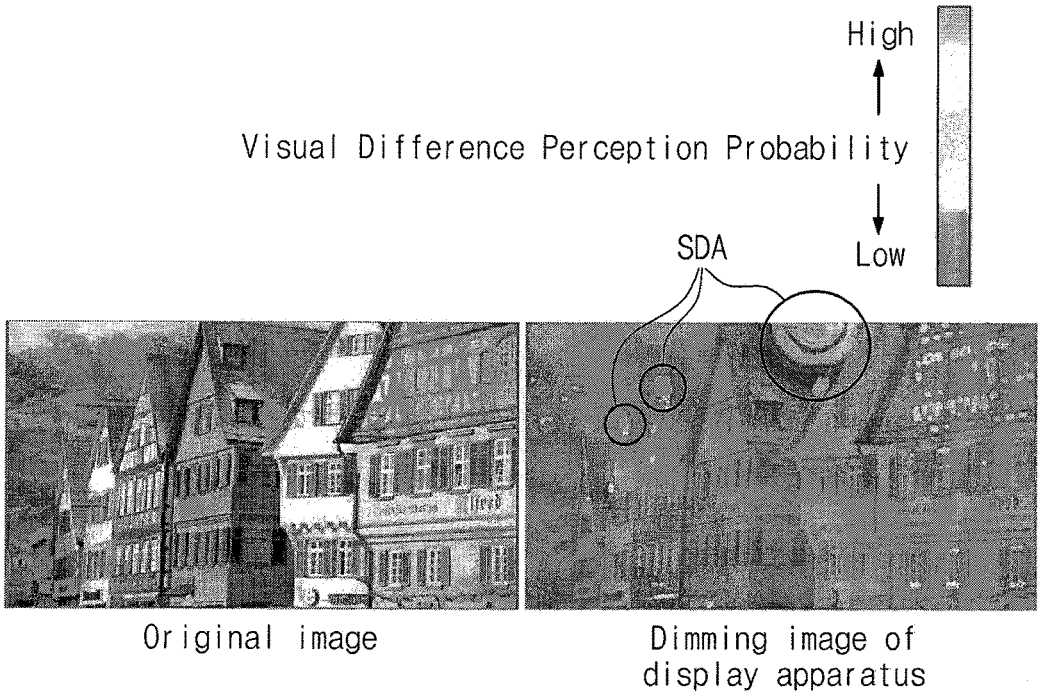
FIG. 15A illustrates the visual difference map of a dimming image generated by another display apparatus.
Figure 15B:
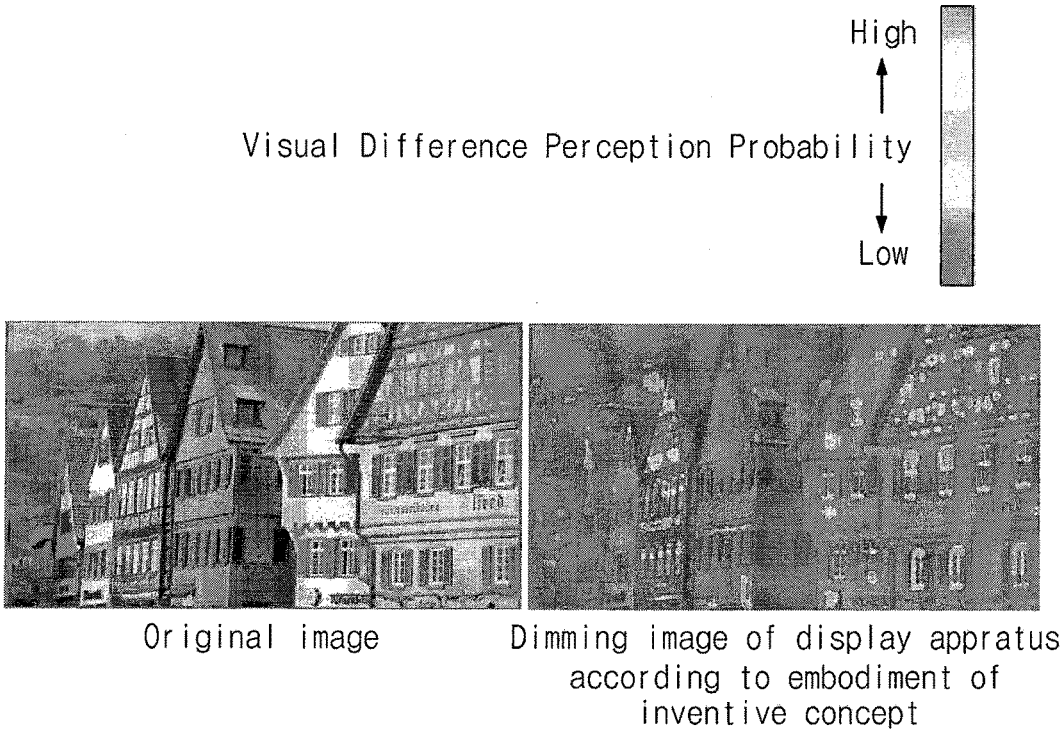
FIG. 15B illustrates the image difference map of a dimming image generated by a display apparatus according to an embodiment of the inventive concept.

FIG. 15A represents the visual difference map of a dimming image generated by another display apparatus, and FIG. 15B represents the image difference map of a dimming image generated by a display apparatus according to an embodiment of the inventive concept.

FIG. 15A shows an original image (on the left hand side) and the visual difference map (on the right hand side) of a dimming image generated by the other display apparatus when the viewing distance is about 5 m, and FIG. 15B shows an original image (on the left hand side) and the visual difference map (on the right hand side) of a dimming image generated by the display apparatus 2000 when the viewing distance is about 5 m.

The visual difference of an image dimmed by the other display apparatus is strongly concentrated at a relatively strong deterioration area (SDA) when compared to that of the display apparatus 2000. Thus, the SDA has a wider area than the maximum clipping area, and has a relatively high visual difference perception probability. Thus, a viewer may easily perceive a deterioration image from an image displayed on the other display apparatus.

On the other hand, the visual difference of an image dimmed by the display apparatus 2000 is weakly and evenly distributed over the entire image when compared to that of the image dimmed by the other display apparatus. Also, an area on which the visual difference is represented is smaller than the maximum clipping area, and has a relatively low visual difference perception probability. Accordingly, the image of the dimming areas D1_1 to Dn_4 (see FIG. 8) processed by the display apparatus 2000 may have similar perceived image quality with each other. Thus, the viewer may not easily perceive the visual difference of the display apparatus 2000 that is weakly and evenly distributed. As a result, it may be difficult for the viewer to perceive a deterioration image from an image displayed on the display apparatus 2000.

According to some embodiments of the inventive concept, dimming is performed based on the maximum clipping area. As a result, since elements related to the deterioration perception possibility of a viewer according to the viewing distance are reflected, the image quality of the display apparatus may be improved, and the power consumption of the backlight unit may decrease.

While various embodiments are described above, a person skilled in the art may understand that various different modifications and variations may be implemented without departing from the spirit and scope of the inventive concept as defined in the following claims, and their equivalents. Also, embodiments disclosed in the present disclosure are not intended to limit the technical spirit of the inventive concept and the following claims and all technical spirits falling within the equivalent scope thereof are construed as being included in the scope of rights of the inventive concept.

What is claimed is:

1. A method for operating a display apparatus, the method comprising:

determining a maximum clipping area based on a viewing distance of a viewer;

generating a first clipping point based on at least the maximum clipping area;

determining a final clipping point based on at least the first clipping point;

generating output image data based on the final clipping point and input image data;

displaying an image corresponding to the output image data;

generating a backlight control signal based on the final clipping point; and emitting backlight based on the backlight control signal, wherein the maximum clipping area includes a maximum area of a deterioration area that cannot be perceived by a viewer according to the viewing distance.

2. The method of claim 1, further comprising:

receiving a minimum peak signal noise ratio (PSNR); and generating a second clipping point based on at least the minimum PSNR, wherein the determining of the final clipping point comprises generating the final clipping point based on the first and second clipping points.

3. The method of claim 2, wherein the determining of the final clipping point comprises:

selecting the second clipping point when the first clipping point is smaller than the second clipping point; and selecting the first clipping point when the first clipping point is greater than the second clipping point.

4. The method of claim 2, wherein the generating of the first clipping point comprises:

determining a maximum number of clipping pixels based on the maximum clipping area and on a number of pixels per unit area of a display panel; and generating the first clipping point based on the maximum number of clipping pixels.

5. The method of claim 4, wherein the maximum number of clipping pixels is determined by Nmax=CAmax×PDA, where Nmax refers to the maximum number of clipping pixels, CAmax refers to the maximum clipping area and PDA refers to the number of pixels per unit area of the display panel.

6. The method of claim 4, wherein the generating of the first clipping point comprises:

generating a histogram according to gray scale levels of the input image data; and generating the first clipping point based on the histogram and the maximum number of clipping pixels.

7. The method of claim 6, wherein the first clipping point is determined by $$Ncp(g) = \sum_{k=g}^{255} Hist(k)$$

$$Ncp(g) < N\max,$$

where Ncp(g) refers to a number of plurality of pixel data of the input image data that is clipped when the first clipping point CP1 is g, Hist(k) refers to the number of plurality of pixel data corresponding to a gray scale value of k, and Nmax refers to the maximum number of clipping pixels.

8. The method of claim 4, wherein the generating of the second clipping point comprises:

generating a maximum clipping level based on the minimum PSNR; and extracting a maximum gray scale value of the input image data, wherein the second clipping point includes a value obtained by subtracting the maximum clipping level from the maximum gray scale value of the input image data.

9. The method of claim 8, wherein the maximum clipping level CLmax is determined by $$CL\max = \frac{255}{10^{\frac{PSNRmin}{20}}},$$

where PSNRmin refers to the minimum PSNR.

10. The method of claim 8, wherein the input image data comprises a plurality of sub input image data corresponding respectively to a plurality of dimming areas of the display panel, the first clipping point comprises a plurality of first sub clipping points corresponding respectively to the dimming areas, and the generating of the first clipping point comprises generating a plurality of sub histograms based respectively on the gray scale values of the plurality of sub input image data, and generating the plurality of first sub clipping points based respectively on the plurality of sub histograms and the maximum number of clipping pixels.

11. The method of claim 10, wherein the second clipping point comprises a plurality of second sub clipping points corresponding to the dimming areas, and the generating of the second clipping point comprises respectively generating block reference values of the dimming areas based on the plurality of sub input image data, and generating the second sub clipping points by subtracting the maximum clipping level from the block reference values.

12. The method of claim 11, wherein the block reference values include maximum gray scale values of the plurality of sub input image data, respectively.

13. The method of claim 12, wherein the generating of the second clipping point comprises:

calculating average gray scale values of sub dimming areas of each of the dimming areas; and generating a maximum value of the average gray scale values of each of the dimming areas as the block reference values.

14. The method of claim 11, wherein the determining of the final clipping point comprises generating a plurality of sub final clipping points of the final clipping point based respectively on the first and second sub clipping points, the generating of the output image data comprises generating a plurality of sub output image data based respectively on the sub final clipping points, the generating of the backlight control signal comprises generating a plurality of sub backlight control signals of the backlight control signal based respectively on the sub final clipping points, and the dimming areas respectively display images corresponding to the plurality of sub image data, and a plurality of light source blocks corresponding respectively to the dimming areas emit backlight corresponding respectively to the sub backlight controls signals.

15. The method of claim 2, wherein the maximum clipping area CAmax is determined by $CAmax=CAnorm \times D^2$, where D refers to the viewing distance, and CAnorm refers to a normalized maximum clipping area for a viewing distance equal to about 1 m.

16. The method of claim 1, further comprising sensing the viewing distance.

17. A display apparatus comprising:

a backlight source configured to emit backlight based on a backlight control signal;

a display panel configured to receive the backlight and to display an image corresponding to output image data; and a controller comprising:

a clipping point processor configured to determine a maximum clipping area based on a viewing distance of a viewer, to generate a first clipping point based on at least the maximum clipping area, and to determine a final clipping point based on at least the first clipping point;

an image processor configured to generate the output image data based on the final clipping point and input image data; and a backlight controller configured to generate the backlight control signal based on the final clipping point, wherein the maximum clipping area includes a maximum area of a deterioration area that cannot be perceived by the viewer according to the viewing distance.

18. The display apparatus of claim 17, wherein the clipping point processor comprises:

a first clipping point generator configured to generate the first clipping point based on at least the maximum clipping area;

a second clipping point generator configured to generate a second clipping point based on at least a minimum PSNR; and a final clipping point determiner configured to generate the final clipping point based on the first and second clipping points.

19. The display apparatus of claim 18, wherein the first clipping point generator is configured to determine a maximum number of clipping pixels based on the maximum clipping area and a number of pixels per unit area of the display panel, and to generate the first clipping point based on the maximum number of clipping pixels.

20. The display apparatus of claim 19, wherein the first clipping point generator is configured to generate a histogram based on gray scale values of the input image data, and to generate the first clipping point based on the histogram and the maximum number of clipping pixels.

* * * * *